US011673231B2

(12) United States Patent
Amino et al.

(10) Patent No.: US 11,673,231 B2
(45) Date of Patent: Jun. 13, 2023

(54) VITRIFIED BOND SUPER-ABRASIVE GRINDING WHEEL

(71) Applicant: A.L.M.T. Corp., Tokyo (JP)

(72) Inventors: Shuichi Amino, Kato (JP); Tomohiro Ishizu, Kato (JP)

(73) Assignee: A.L.M.T. Corp., Tokyo (JP)

( * ) Notice: Subject to any disclaimer, the term of this patent is extended or adjusted under 35 U.S.C. 154(b) by 328 days.

(21) Appl. No.: 16/652,532

(22) PCT Filed: Sep. 18, 2018

(86) PCT No.: PCT/JP2018/034362
§ 371 (c)(1),
(2) Date: Mar. 31, 2020

(87) PCT Pub. No.: WO2019/073753
PCT Pub. Date: Apr. 18, 2019

(65) Prior Publication Data

US 2020/0238477 A1 Jul. 30, 2020

(30) Foreign Application Priority Data

Oct. 11, 2017 (JP) ..... JP2017-197407

(51) Int. Cl.
*B24D 3/14* (2006.01)
*B24D 3/18* (2006.01)
(Continued)

(52) U.S. Cl.
CPC ..... *B24D 3/14* (2013.01)

(58) Field of Classification Search
CPC ... B24D 3/02; B24D 3/04; B24D 3/14; B24D 3/18
See application file for complete search history.

(56) References Cited

U.S. PATENT DOCUMENTS

2002/0151265 A1 10/2002 Adefris
2006/0137256 A1 6/2006 Yui et al.
(Continued)

FOREIGN PATENT DOCUMENTS

CN 101396808 A 4/2009
CN 105818007 A 8/2016
(Continued)

OTHER PUBLICATIONS

Extended European Search Report issued in counterpart EP Patent Application No. 18865864.5 dated Nov. 25, 2020.
(Continued)

*Primary Examiner* — Pegah Parvini
(74) *Attorney, Agent, or Firm* — McCarter & English, LLP.; Michael A. Sartori

(57) ABSTRACT

There is provided a vitrified bond super-abrasive grinding wheel including: a core; and a super-abrasive grain layer provided on the core, wherein the super-abrasive grain layer includes a plurality of super-abrasive grains and a vitrified bond that joins the plurality of super-abrasive grains, and the vitrified bond has a plurality of bond bridges located between the plurality of super-abrasive grains to join the plurality of super-abrasive grains, not less than 80% of the plurality of super-abrasive grains are joined to the super-abrasive grains adjacent thereto by the bond bridges, and not less than 90% of the plurality of bond bridges in a cross section of the super-abrasive grain layer have a thickness equal to or smaller than an average grain size of the super-abrasive grains, and have a length greater than the thickness.

3 Claims, 3 Drawing Sheets

(51) Int. Cl.
*B24D 3/02* (2006.01)
*B24D 3/04* (2006.01)

(56) References Cited

U.S. PATENT DOCUMENTS

| | | | | |
|---|---|---|---|---|
| 2009/0088056 | A1 | 4/2009 | Takehara et al. | |
| 2014/0013673 | A1* | 1/2014 | Takehara | B24D 3/14 51/307 |
| 2014/0349557 | A1* | 11/2014 | Mizuno | B24D 5/06 451/542 |
| 2016/0214233 | A1 | 7/2016 | Kasuga et al. | |
| 2016/0311083 | A1 | 10/2016 | Kasuga | |
| 2017/0008153 | A1 | 1/2017 | Sivasubramanian et al. | |

FOREIGN PATENT DOCUMENTS

| | | | | |
|---|---|---|---|---|
| CN | 106078538 | A | 11/2016 | |
| EP | 0888849 | A2 | 1/1999 | |
| EP | 1 634 678 | * | 3/2006 | B24D 3/18 |
| EP | 3117959 | A1 | 1/2017 | |
| JP | S62-094262 | A | 4/1987 | |
| JP | H07-9344 | A | 1/1995 | |
| JP | 2000-343438 | A | 12/2000 | |
| JP | 2002-224963 | A | 8/2002 | |
| JP | 2003-532550 | A | 11/2003 | |
| JP | 2009-061554 | A | 3/2009 | |
| JP | 5316053 | B2 | 10/2013 | |
| JP | 2014-012328 | A | 1/2014 | |
| JP | 2014-083621 | A | 5/2014 | |
| JP | 2016-137536 | A | 8/2016 | |
| JP | 2016-172306 | A | 9/2016 | |
| TW | 201702349 | A | 1/2017 | |
| WO | 01/85393 | A1 | 11/2001 | |
| WO | 2004/106001 | A1 | 12/2004 | |

OTHER PUBLICATIONS

Yokogawa et al., "CBN Wheel Grinding Technique-Driving Force of Production Revolution," Kogyo Chosakai Publishing Co., Ltd., 2021, pp. 25-26 & 112-113.
Notification issued in counterpart Japanese Patent Application No. 2019-547958 dated Apr. 6, 2021.
Decision of Examination issued in counterpart Taiwanese Patent Application No. 107133131 dated Aug. 30, 2021.
Notification of the First Office Action issued in counterpart CN Patent Application No. 201880065784.2 dated Mar. 16, 2021.
Office Action issued in counterpart JP Application No. 2019-547958, dated Oct. 18, 2022.
Partial English Translation of JP Patent Application No. 2002-224963 dated Aug. 13, 2002, included in Office Action cited in NPL1.

* cited by examiner

VITRIFIED BOND SUPER-ABRASIVE GRINDING WHEEL

TECHNICAL FIELD

The present invention relates to a vitrified bond super-abrasive grinding wheel. The present application claims priority based on Japanese Patent Application No. 2017-197407 filed on Oct. 11, 2017. The entire contents of the Japanese patent application is incorporated herein by reference.

BACKGROUND ART

Conventionally, a vitrified bond super-abrasive grinding wheel is disclosed in, for example, Japanese Patent Laying-Open No. 2002-224963 (PTL 1).

CITATION LIST

Patent Literature

PTL 1: Japanese Patent Laying-Open No. 2002-224963

SUMMARY OF INVENTION

A vitrified bond super-abrasive grinding wheel according to the present invention includes: a core; and a super-abrasive grain layer provided on the core, wherein the super-abrasive grain layer includes a plurality of super-abrasive grains and a vitrified bond that joins the plurality of super-abrasive grains, and the vitrified bond has a plurality of bond bridges located between the plurality of super-abrasive grains to join the plurality of super-abrasive grains, not less than 80% of the plurality of super-abrasive grains are joined to the super-abrasive grains adjacent thereto by the bond bridges, and not less than 90% of the plurality of bond bridges in a cross section of the super-abrasive grain layer have a thickness equal to or smaller than an average grain size of the super-abrasive grains, and have a length greater than the thickness.

DETAILED DESCRIPTION

Figure 1:
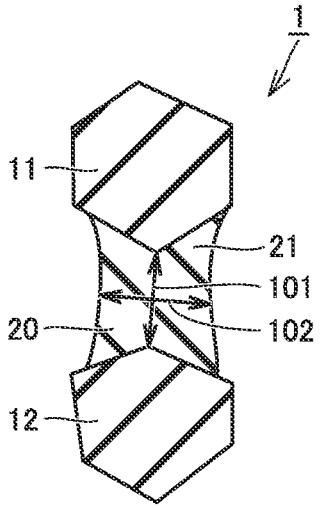
FIG. 1 is a schematic view of a super-abrasive grain layer of a vitrified bond super-abrasive grinding wheel according to a first embodiment.

Problem to be Solved by the Present Disclosure

In conventional art, there is a problem such as short lifetime. Accordingly, the present invention has been made to solve the above-described problem, and an object of the present invention is to provide a vitrified bond super-abrasive grinding wheel having a long lifetime.

DESCRIPTION OF EMBODIMENTS

Embodiments of the present invention will be described. A vitrified bond super-abrasive grinding wheel according to an embodiment of the present invention includes: a core; and a super-abrasive grain layer provided on the core, wherein the super-abrasive grain layer includes a plurality of super-abrasive grains and a vitrified bond that joins the plurality of super-abrasive grains, and the vitrified bond has a plurality of bond bridges located between the plurality of super-abrasive grains to join the plurality of super-abrasive grains, not less than 80% of the plurality of super-abrasive grains are joined to the super-abrasive grains adjacent thereto by the bond bridges, and not less than 90% of the plurality of bond bridges in a cross section of the super-abrasive grain layer have a thickness equal to or smaller than an average grain size of the super-abrasive grains, and have a length greater than the thickness.

The super-abrasive grain layer may include not less than 20 volume % and not more than 60 volume % of the super-abrasive grains. By setting a ratio of the super-abrasive grains to be within this range, sharpness can be further improved.

In the super-abrasive grain layer, a volume ratio of a total of the vitrified bond, the super-abrasive grains and a pore may be not less than 99%. When the volume ratio is within this range, an amount of an impurity is small and the lifetime of the super-abrasive grain layer can be further improved. The above-described volume ratio is preferably not less than 99.5%, and more preferably not less than 99.9%. Most preferably, the super-abrasive grain layer consists only of the vitrified bond, the super-abrasive grains, the pore, and an unavoidable impurity.

The vitrified bond may include not less than 30 mass % and not more than 60 mass % of $SiO_2$, not less than 2 mass % and not more than 20 mass % of $Al_2O_3$, not less than 10 mass % and not more than 40 mass % of $B_2O_3$, not less than 1 mass % and not more than 10 mass % of RO (RO is at least one type of oxide selected from CaO, MgO and BaO), and not less than 2 mass % and not more than 5 mass % of $R_2O$ ($R_2O$ is at least one type of oxide selected from $Li_2O$, $Na_2O$ and $K_2O$).

The vitrified bond super-abrasive grinding wheel is for cutting and processing a wafer made of a brittle material such as silicon or LT (lithium tantalate), in addition to a hard and brittle material such as SiC, GaN or sapphire.

A vitrified bond grinding wheel is conventionally used to grind a semiconductor wafer or the like.

In a vitrified bond super-abrasive grinding wheel, abrasive grains are joined by a vitreous bond material mainly composed of silicon dioxide or the like, and thus, the abrasive grain holding power is strong and long-time grinding is possible. However, since the abrasive grain holding power is high and the self-sharpening function is insufficient, a grinding resistance value becomes high as grinding continues. Therefore, the grinding resistance value may be unstable.

In the vitrified bond super-abrasive grinding wheel disclosed in PTL 1, a pore diameter is controlled and a vitrified bond having a particular composition is used. Thus, in grinding of a difficult-to-grind material such as PCD (polycrystalline diamond), abrasive grains can be strongly held and falling abrasive grains can be held in a pore portion, and formation of a streak on a processed surface is thereby prevented. In processing of a difficult-to-grind material such as PCD, dressing of a super-abrasive grain layer is performed simultaneously with grinding in order to maintain excellent sharpness.

In processing of a semiconductor wafer or the like, long-time continuation of excellent sharpness without dressing after dressing is performed on a machine having a grinding wheel attached thereto and a long lifetime of the grinding wheel are required.

The present inventor has conducted earnest study in order to make long-time grinding possible in a vitrified bond super-abrasive grinding wheel. As a result, the present inventor has found that a dispersion state of a vitrified bond affects the performance of the vitrified bond super-abrasive grinding wheel.

In the conventional vitrified bond super-abrasive grinding wheel, the super-abrasive grains are strongly held by the vitrified bond. However, a dispersion state of the super-abrasive grains and the vitrified bond has considerable variations. When such a grinding wheel is used to grind a semiconductor wafer or the like, the self-sharpening function does not continue well, which may lead to deterioration of sharpness, or a lump of the super-abrasive grains and the vitrified bond falls, which may lead to shorter lifetime of the grinding wheel.

The present inventor has found that, by solving the above-described problem, it is possible to provide a vitrified bond super-abrasive grinding wheel that can achieve long-time continuation of excellent sharpness and a long lifetime. Specifically, a super-abrasive grain layer that can achieve excellent sharpness and a long lifetime can be provided by making a distribution of super-abrasive grains and a vitrified bond as uniform as possible, and reducing a thickness of the vitrified bond that joins the super-abrasive grains so as to allow the self-sharpening function to be performed appropriately without generating excessively high joining power.

FIG. 1 is a cross-sectional view of a super-abrasive grain layer according to a first embodiment. In FIG. 1, a single bond bridge 21 is present between two super-abrasive grains 11 and 12. The shortest distance (length of an arrow 101) between adjacent two super-abrasive grains 11 and 12 is defined as "thickness". A length (length of an arrow 102) of the normal to the thickness extending in bond bridge 21 at an intermediate point of the thickness is defined as "length". A vitrified bond 20 has bond bridge 21. Not only bond bridge 21 shown in FIG. 1 but also a plurality of bond bridges 21 are present in a super-abrasive grain layer 1.

Figure 2:
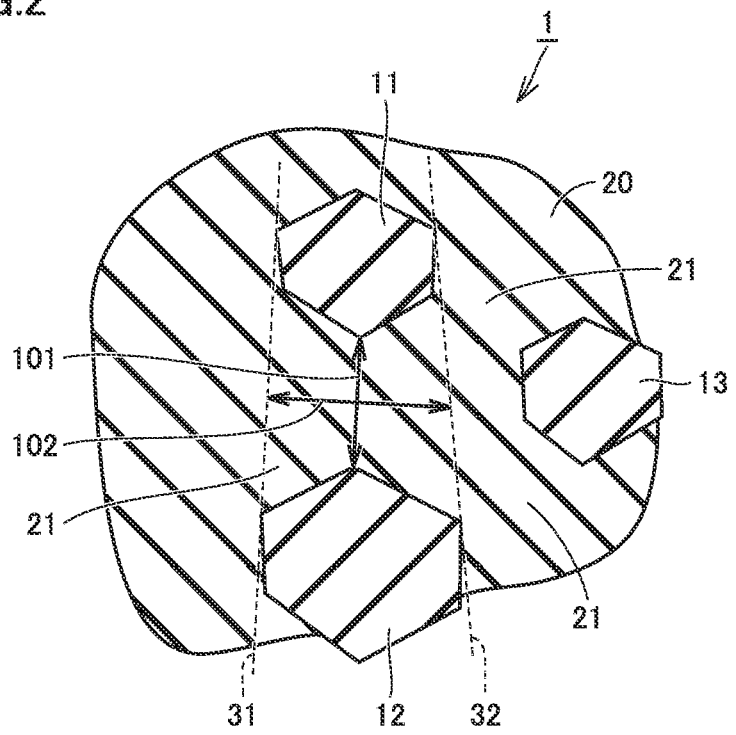
FIG. 2 is a schematic view of a super-abrasive grain layer of a vitrified bond super-abrasive grinding wheel according to a second embodiment.

FIG. 2 is a cross-sectional view of a super-abrasive grain layer according to a second embodiment. In FIG. 2, when a plurality of bond bridges 21 are integrated, a thickness and a length of bond bridge 21 are defined for each super-abrasive grain. Between a super-abrasive grain 11 and a super-abrasive grain 12, a dotted line 31 represents a circumscribed straight line connecting outermost perimeters on one side of super-abrasive grains 11 and 12, and a dotted line 32 represents a circumscribed straight line connecting outermost perimeters on the other side of super-abrasive grains 11 and 12. The shortest distance (length of an arrow 101) between super-abrasive grains 11 and 12 is defined as a thickness of bond bridge 21, and a length (length of an arrow 102) of the normal to the thickness extending between dotted lines 31 and 32 at an intermediate point of the thickness is defined as a length of bond bridge 21. A region surrounded by dotted lines 31 and 32 is regarded as bond bridge 21.

Figure 3:
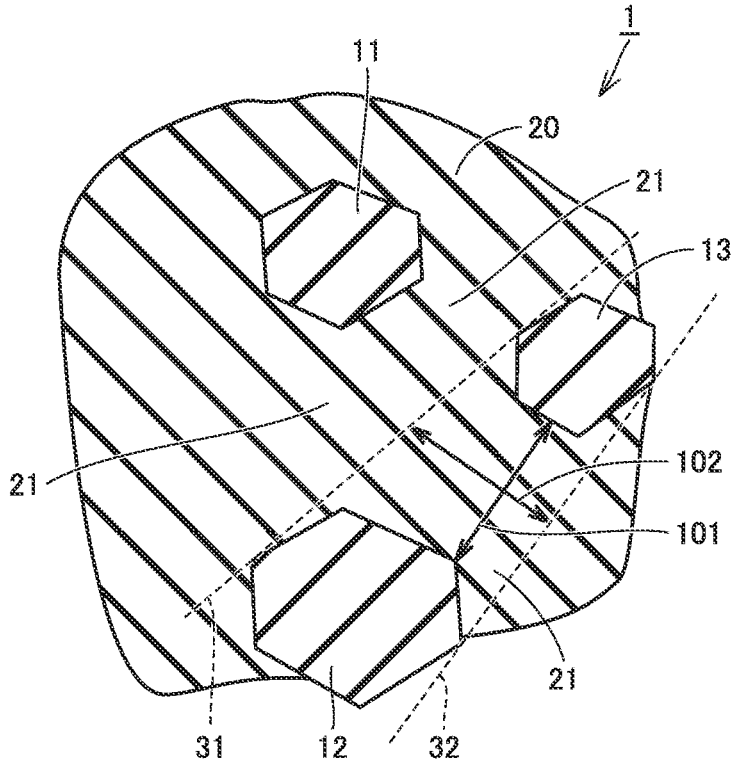
FIG. 3 is a schematic view of the super-abrasive grain layer of the vitrified bond super-abrasive grinding wheel according to the second embodiment.

FIG. 3 is a cross-sectional view of the super-abrasive grain layer according to the second embodiment. Between a super-abrasive grain 13 and super-abrasive grain 12, a dotted line 31 represents a circumscribed straight line connecting outermost perimeters on one side of super-abrasive grains 11 and 12, and a dotted line 32 represents a circumscribed straight line connecting outermost perimeters on the other side of super-abrasive grains 13 and 12. The shortest distance (length of an arrow 101) between super-abrasive grains 13 and 12 is defined as a thickness of bond bridge 21, and a length (length of an arrow 102) of the normal to the thickness extending between dotted lines 31 and 32 at an intermediate point of the thickness is defined as a length of bond bridge 21. A region surrounded by dotted lines 31 and 32 is regarded as bond bridge 21.

An average grain size of each of super-abrasive grains 11, 12 and 13 is preferably 0.1 to 100 μm. Each of super-abrasive grains 11, 12 and 13 is diamond or CBN.

[Ingredients of Vitrified Bond]

Ingredients of vitrified bond 20 are not particularly limited. For example, vitrified bond 20 includes not less than 30 mass % and not more than 60 mass % of $SiO_2$, not less than 2 mass % and not more than 20 mass % of $Al_2O_3$, not less than 10 mass % and not more than 40 mass % of $B_2O_3$, not less than 1 mass % and not more than 10 mass % of RO (RO is at least one type of oxide selected from CaO, MgO and BaO), and not less than 2 mass % and not more than 5 mass % of $R_2O$ ($R_2O$ is at least one type of oxide selected from $Li_2O$, $Na_2O$ and $K_2O$).

[Method for Measuring Bond Bridge]

When bond bridge 21 is measured, a square range having a size that includes approximately 100 super-abrasive grains 11, 12 and 13 is selected in a cross section of super-abrasive grain layer 1.

A dimension of bond bridge 21 is defined as described in the first and second embodiments above. Super-abrasive grain layer 1 is cut with a diamond cutter, an epoxy resin is filled to surround super-abrasive grain layer 1 such that the cut surface is exposed, and the cut surface is polished using an ion milling method. The polished surface is observed and an image of the polished surface is taken using an SEM (scanning electron microscope). On the taken photograph, super-abrasive grains 11, 12 and 13 look gray, vitrified bond 20 looks gray close to white, and a pore looks gray close to black. A transparent sheet is placed on the taken photograph and an observer traces super-abrasive grains 11, 12 and 13 and vitrified bond 20 onto the transparent sheet. The observer also draws dotted lines 31 and 32. Furthermore, the observer determines the thickness and the length of bond bridge 21.

[Method for Measuring Volume Ratio]

A new transparent sheet is placed on the photograph observed and taken using the above-described SEM, and the observer traces only a portion corresponding to the super-abrasive grains and colors the portion with black. Image analysis software is used for binarization into the black portion and the other portion, and the image analysis software determines an area ratio of the black portion. This is defined as an area ratio of the super-abrasive grains.

A new transparent sheet is placed on the photograph observed and taken using the above-described SEM, and the observer traces only a portion corresponding to the vitrified bond and colors the portion with black. The image analysis software is used for binarization into the black portion and the other portion, and the image analysis software determines an area ratio of the black portion. This is defined as an area ratio of the vitrified bond.

A new transparent sheet is placed on the photograph observed and taken using the above-described SEM, and the observer traces only a portion corresponding to the pore and colors the portion with black. The image analysis software is used for binarization into the black portion and the other portion, and the image analysis software determines an area ratio of the black portion. This is defined as an area ratio of the pore.

The determined area ratios are regarded as volume ratios of the super-abrasive grains, the vitrified bond and the pore.

[Method for Measuring Average Grain Size of Super-Abrasive Grains]

In order to measure an average grain size of the super-abrasive grains included in the vitrified bond super-abrasive grinding wheel, the whole of the binder of the super-abrasive grain layer is dissolved with an acid or the like to extract the super-abrasive grains. When the super-abrasive grinding wheel is large, only a prescribed volume (e.g., 0.5 $cm^3$) of the super-abrasive grain layer is cut out, the vitrified bond material is dissolved with an acid or the like to extract the super-abrasive grains, and the average grain size is measured using a laser diffraction-type grain size distribution measurement apparatus (e.g., SALD series manufactured by Shimadzu Corporation).

[Method for Manufacturing Vitrified Bond Super-Abrasive Grinding Wheel]

The vitrified bond super-abrasive grinding wheel is manufactured in accordance with the following procedure.

(1) The super-abrasive grains and the vitrified bond are mixed and sintered. A temperature of sintering is set at 700 to 900° C.

(2) A sintered material of the super-abrasive grains and the vitrified bond is put into a ball mill and crushed.

(3) The crushed sintered material and grains of the vitrified bond are mixed, and molded and sintered again.

By adjusting a mixing ratio between the super-abrasive grains and the vitrified bond in (1), or by adjusting the time of crushing or the like in (2), an amount of the vitrified bond adhering to the super-abrasive grains during crushing can be controlled.

Since the joining power of the super-abrasive grains is not very high, sharpness can be continued stably for a long time. Furthermore, a fall of a lump of the super-abrasive grains and the vitrified bond is also significantly reduced, which leads to improvement in lifetime. As a result, low-load and low-wear grinding is possible, although a surface roughness is equal to that of a conventional grinding wheel.

Since a filler is not included in the super-abrasive grain layer, the joining power is prevented from becoming excessively high, and the super-abrasive grains fall appropriately and the self-sharpening function is performed, and thus, excellent sharpness is continued for a long time. If the filler is included, the joining power between the filler and the vitrified bond becomes high and the super-abrasive grains around the filler become less likely to fall by themselves. Furthermore, the joining power around the filler is higher than the joining power of the super-abrasive grains in a portion that does not include the filler. Therefore, there arises a phenomenon in which a lump of the filler, the super-abrasive grains and the vitrified bond falls, and thus, wear of the super-abrasive grain layer may be increased, which leads to shorter lifetime of the grinding wheel.

When the cross section of the super-abrasive grain layer is seen in a plan view, most of the super-abrasive grains, i.e., not less than 80% of the super-abrasive grains, are joined by the vitrified bond, and thus, the super-abrasive grains are less likely to fall individually. Since the thickness of the bond bridge of the vitrified bond is not great, the joining power is appropriate and not too high, and thus, a fall of a lump of the super-abrasive grains and the vitrified bond can also be inhibited. Even if all of the super-abrasive grains are joined by the bond bridges when seen in three dimensions, some super-abrasive grains look like they are not joined when seen in two dimensions. When not less than 80% of the super-abrasive grains have the bond bridges and are joined by the bond bridges in the cross section, the number of the super-abrasive grains that fall individually is very small and wear of the super-abrasive grain layer is reduced. A difference between a high joining power portion and a low joining power portion is small and the entire super-abrasive grain layer has well-balanced joining power, and thus, uniform wear is achieved. More preferably not less than 90%, and further preferably not less than 95%, of the plurality of super-abrasive grains are joined to the super-abrasive grains adjacent thereto by the bond bridges in the cross section of the super-abrasive grain layer.

Not less than 90% of the plurality of bond bridges in the cross section of the super-abrasive grain layer have a thickness equal to or smaller than the average grain size of the super-abrasive grains and have a length greater than the thickness. Therefore, self-sharpening is more likely to occur in the super-abrasive grain layer. As a result, sharpness is improved and a load current value for rotating a tool can be reduced.

In PTL 1, a dispersion state of the super-abrasive grains and glass is not uniform and there is a portion like a lump of glass. Therefore, the degree of joining is high and the lump may fall.

In the invention of the embodiment, the vitrified bond is thinly dispersed throughout the super-abrasive grain layer as uniformly as possible, and the joining power of the super-abrasive grains is not extremely increased and variations in joining power are reduced, to thereby achieve uniform wear.

DETAILS OF EMBODIMENT OF THE PRESENT INVENTION

Example 1

A vitrified bond including 43.5 mass % of $SiO_2$, 15.5 mass % of $Al_2O_3$, 32.0 mass % of $B_2O_3$, 4.0 mass % of RO (RO is at least one type of oxide selected from CaO, MgO and BaO), and 5 mass % of $R_2O$ ($R_2O$ is at least one type of oxide selected from $Li_2O$, $Na_2O$ and $K_2O$) was prepared. An average grain size of the vitrified bond was 5 μm.

Diamond was prepared as super-abrasive grains. An average grain size of the diamond was 7 μm.

The vitrified bond and the diamond were mixed by a mixer and sintered at the temperature of 800° C. The sintered material was crushed by a ball mill for 2 hours. After two hours elapsed, an average grain size of the crushed material exceeded 20 μm. Therefore, crushing was continued until the average grain size of the crushed material reached approximately 20 μm.

The crushed material and the vitrified bond were mixed, and molded and sintered again, to thereby form a super-abrasive grain layer. The super-abrasive grain layer was dissolved and the average grain size of the diamond was measured. The super-abrasive grain layer was cut and analyzed. The results are shown in Table 1.

TABLE 1

| | | Example 1 |
|---|---|---|
| Specifications | super-abrasive grains | diamond |
| | average grain size of diamond | 7 μm |
| | composition of vitrified bond | borosilicate-based |
| | volume ratio: diamond | 50.8% |
| | volume ratio: vitrified bond | 12.1% |
| | volume ratio: pore | 37.1% |

TABLE 1-continued

| | | Example 1 |
|---|---|---|
| State of vitrified bond | ratio at which adjacent super-abrasive grains are joined by a bond bridge | 92.7% |
| | ratio of a bond bridge having a thickness equal to or smaller than an average grain size and having a length greater than the thickness | 97.5% |
| | distribution state of vitrified bond | distributed uniformly and joined to super-abrasive grains |

Example 2

In Example 2, the same raw materials as those of Example 1 were used and the time of crushing the sintered material by the ball mill in the manufacturing method was changed, to thereby manufacture a super-abrasive grain layer. The super-abrasive grain layer was dissolved and the average grain size of the diamond was measured. The super-abrasive grain layer was cut and analyzed. The results are shown in Table 2.

TABLE 2

| | | Example 2 |
|---|---|---|
| Specifications | super-abrasive grains | diamond |
| | average grain size of diamond | 7 μm |
| | composition of vitrified bond | borosilicate-based |
| | volume ratio: diamond | 50.9% |
| | volume ratio: vitrified bond | 15.6% |
| | volume ratio: pore | 33.5% |
| State of vitrified bond | ratio at which adjacent super-abrasive grains are joined by a bond bridge | 95.4% |
| | ratio of a bond bridge having a thickness equal to or smaller than an average grain size and having a length greater than the thickness | 97.5% |
| | distribution state of vitrified bond | distributed uniformly and joined to super-abrasive grains |

Example 3

In Example 3, the same raw materials as those of Example 1 were used and the ratio of the vitrified bond in the manufacturing method was changed, to thereby manufacture a super-abrasive grain layer. The super-abrasive grain layer was dissolved and the average grain size of the diamond was measured. The super-abrasive grain layer was cut and analyzed. The results are shown in Table 3.

TABLE 3

| | | Example 3 |
|---|---|---|
| Specifications | super-abrasive grains | diamond |
| | average grain size | 7 μm |
| | composition of vitrified bond | borosilicate-based |
| | volume ratio: diamond | 50.6% |
| | volume ratio: vitrified bond | 14.3% |
| | volume ratio: pore | 35.1% |
| Vitrified bond state | ratio at which adjacent super-abrasive grains are joined by a bond bridge | 80.3% |
| | ratio of a bond bridge having a thickness equal to or smaller than an average grain size and having a length greater than the thickness | 91.1% |
| | distribution state of vitrified bond | distributed relatively uniformly and joined to super-abrasive grains |

Comparative Example 1

In Comparative Example 1, the same raw materials as those of Example 1 were used and the manufacturing method was changed into a method for fabricating a super-abrasive grain layer in one sintering without crushing the sintered material of the super-abrasive grains and the vitrified bond, to thereby manufacture a super-abrasive grain layer. The super-abrasive grain layer was dissolved and the average grain size of the diamond was measured. The super-abrasive grain layer was cut and analyzed. The results are shown in Table 4.

TABLE 4

| | | Comparative Example 1 |
|---|---|---|
| Specifications | super-abrasive grains | diamond |
| | average grain size of diamond | 7 μm |
| | composition of vitrified bond | borosilicate-based |
| | volume ratio: diamond | 50.2% |
| | volume ratio: vitrified bond | 15.1% |
| | volume ratio: pore | 34.7% |
| State of vitrified bond | ratio at which adjacent super-abrasive grains are joined by a bond bridge | 59.0% |
| | ratio of a bond bridge having a thickness equal to or smaller than an average grain size and having a length greater than the thickness | 46.0% |
| | distribution state of vitrified bond | vitrified bond was segregated |

A chip formed of the super-abrasive grain layer in each of Examples 1 to 3 and Comparative Example 1 was bonded to a core made of aluminum alloy by using an adhesive, and thereafter, truing and dressing were performed using a conventional grindstone, to thereby complete a vitrified bond super-abrasive grinding wheel.

The grinding wheel was a segment-type cup wheel (JIS B4131 6A7S type) having an outer diameter of 200 mm, and including a super-abrasive grain layer having a radial width of 4 mm and a thickness of 5 mm.

These vitrified bond super-abrasive grinding wheels were attached to a vertical rotary table-type surface grinder and an SiC wafer having a diameter of 6 inches (15.24 cm) was ground, to thereby check the effects of lifetime and sharpness.

The results are shown in Table 5.

TABLE 5

| | | Example 1 | Example 2 | Example 3 | Comparative Example 1 |
|---|---|---|---|---|---|
| Performance | lifetime | A | A | B | C |
| | sharpness (relative current value) | a | a | b | d |

As to evaluation of the lifetime, the end of the lifetime being reached after 100 wafers are processed is defined as 1.0. For example, when 300 wafers can be processed, the lifetime is 3.

Evaluation A indicates that the lifetime is not less than 3, evaluation B indicates that the lifetime is not less than 1.5 and less than 3, and evaluation C indicates that the lifetime is not less than 0.5 and less than 1.5.

As to evaluation of the sharpness, an average load current value of a spindle motor during grinding in Comparative Example 1 is defined as 1, and evaluation is made in consideration of a relative load current value (referred to as "relative current value" and defined by (load current value of spindle motor during grinding in each Example)/(average load current value of spindle motor during grinding in Comparative Example 1)) of a spindle motor during grinding in each Example with respect to the average load current value of the spindle motor during grinding in Comparative Example 1 and the number of processed wafers.

Evaluation a indicates that the relative current value is less than 0.5 and 300 or more wafers can be processed from beginning to end. Evaluation b indicates that the relative current value is initially less than 0.5, and increases to be not less than 0.5 and less than 0.7 after 300 wafers are processed. Evaluation c indicates that the relative current value is not less than 0.7 from the beginning.

It can be seen that the lifetime and the sharpness are improved in Examples 1 to 3 as compared with Comparative Example 1.

This is considered to be because not less than 90% of the super-abrasive grains are joined by the bond bridges and wear can thereby be reduced in Example 1. Since not less than 90% of the bond bridges have a thickness equal to or smaller than the average grain size of the super-abrasive grains and have a length greater than the thickness, self-sharpening is likely to occur and the load current value can be reduced.

In Example 2, a larger amount (not less than 95%) of the super-abrasive grains than those of Example 1 are joined by the bond bridges and a thickness of each bond bridge is also preferable. Furthermore, there is a tendency of lower load and longer lifetime.

In Example 3, the ratio at which the adjacent super-abrasive grains are joined by the bridge is approximately 80%, which is slightly lower than those of Examples 1 and 2, and thus, the lifetime is shorter. In addition, as to the sharpness, the current value becomes larger as processing progresses.

In Comparative Example 1, glass is segregated, and the portion having strong joining power and the portion having weak joining power are mixed. Therefore, a lump of the abrasive grain layer tends to fall.

It should be understood that the embodiments and examples disclosed herein are illustrative and non-restrictive in every respect. The scope of the present invention is defined by the terms of the claims, rather than the embodiments above, and is intended to include any modifications within the scope and meaning equivalent to the terms of the claims.

REFERENCE SIGNS LIST

1 super-abrasive grain layer; 11, 12, 13 super-abrasive grain; 20 vitrified bond; 21 bond bridge.

The invention claimed is:

1. A vitrified bond super-abrasive grinding wheel comprising:

a core; and a super-abrasive grain layer provided on the core, wherein the super-abrasive grain layer includes a plurality of super-abrasive grains and a vitrified bond that joins the plurality of super-abrasive grains, and the vitrified bond has a plurality of bond bridges located between the plurality of super-abrasive grains to join the plurality of super-abrasive grains, in a cross section of the super-abrasive grain layer, not less than 80% of the plurality of super-abrasive grains are joined to the super-abrasive grains adjacent thereto by the bond bridges, not less than 90% of the plurality of bond bridges in the cross section of the super-abrasive grain layer have a thickness equal to or smaller than an average grain size of the super-abrasive grains, and have a length greater than the thickness, wherein the thickness is a shortest distance between two adjacent super-abrasive grains and the length is a distance of a bond bridge extending at an intermediate point of the thickness at a direction normal to the thickness, the super-abrasive grain layer includes not less than 20 volume % and not more than 60 volume % of the super-abrasive grains, and the super-abrasive grains consisting of diamond.

2. The vitrified bond super-abrasive grinding wheel according to claim 1, wherein in the super-abrasive grain layer, a volume ratio of a total of the vitrified bond, the super-abrasive grains and a pore is not less than 99%.

3. The vitrified bond super-abrasive grinding wheel according to claim 1, wherein the vitrified bond includes not less than 30 mass % and not more than 60 mass % of $SiO_2$, not less than 2 mass % and not more than 20 mass % of $Al_2O_3$, not less than 10 mass % and not more than 40 mass % of $B_2O_3$, not less than 1 mass % and not more than 10 mass % of RO (RO is at least one type of oxide selected from CaO, MgO and BaO), and not less than 2 mass % and not more than 5 mass % of $R_2O$ ($R_2O$ is at least one type of oxide selected from $Li_2O$, $Na_2O$, and $K_2O$).

* * * * *